US005761578A

United States Patent [19]

Cousoulis et al.

[11] Patent Number: 5,761,578

[45] Date of Patent: Jun. 2, 1998

[54] CORONA WIRE CLEANING BY MECHANICAL VIBRATION OF THE WIRE

[75] Inventors: Marc Cousoulis; Mark J. Muranyi, both of Grand Island; James R. Halliday, Lewiston, all of N.Y.

[73] Assignee: Moore Business Forms, Inc., Grand Island, N.Y.

[21] Appl. No.: 629,089

[22] Filed: Apr. 8, 1996

[51] Int. Cl.[6] ..... G03G 15/10

[52] U.S. Cl. ..... 399/100; 399/266; 399/290; 399/292

[58] Field of Search ..... 355/247–249, 355/261–264, 245, 259; 118/654; 399/100, 119, 266, 290, 291, 292, 293

[56] References Cited

U.S. PATENT DOCUMENTS

| | | | |
|---|---|---|---|
| 4,073,587 | 2/1978 | Selwyn | 399/100 |
| 4,516,848 | 5/1985 | Moriya | 399/100 |
| 4,746,796 | 5/1988 | Heigl | 250/324 |
| 4,777,106 | 10/1988 | Fotland | 430/120 |
| 4,984,019 | 1/1991 | Folkins | 355/215 |
| 5,023,748 | 6/1991 | Okamoto et al. | 355/215 |
| 5,134,442 | 7/1992 | Folkins et al. | 355/264 |
| 5,144,370 | 9/1992 | Bares | 399/266 |
| 5,321,474 | 6/1994 | Bares | 355/247 |
| 5,337,131 | 8/1994 | Sagiv et al. | 355/221 |
| 5,392,099 | 2/1995 | Kusumoto et al. | 355/221 |

FOREIGN PATENT DOCUMENTS 494 454 7/1992 European Pat. Off. .

*Primary Examiner*—Sandra L. Brase
*Assistant Examiner*—Quana Grainger
*Attorney, Agent, or Firm*—Nixon & Vanderhye P.C.

[57] ABSTRACT

Non-magnetic toner in a fluidized bed is charged by at least one corona wire extending through the bed, the non-magnetic toner surrounding the wire in the fluidized bed. In order to prevent build up of insulating particles on the corona wire (which leads to a change in electric field gradient and eventually adversely impacts on the uniformity of the image applied to the substrate with the toner) is substantially precluded by vibrating the wire to shake toner particles off the wire. Vibration is accomplished at spaced points in time, such as by utilizing a rod having an irregular (e.g. substantially sinusoidal shaped) surface and by reciprocating the rod to cause the irregular surface to engage the wire and cause a quick rise and release thereof, so that the wire goes through a wide series of frequencies when vibrating. The rod may be reciprocated by a pneumatic cylinder, and may be of stainless steel having a substantially circular cross section with a diameter between about 0.02–0.04 inches. The at least one corona wire is connectable to a source of electric current and extends between and is supported by first and second corona wire support structures. A number of high strength fiberglass rods may extend between the support structures for positioning shielding, and a spring may be associated with a support structure for engaging and mounting the wire at or adjacent one end of the wire. The support structure may also include a guide (such as the spaced sets of ball bearings) for precisely guiding the rod during reciprocation.

14 Claims, 3 Drawing Sheets

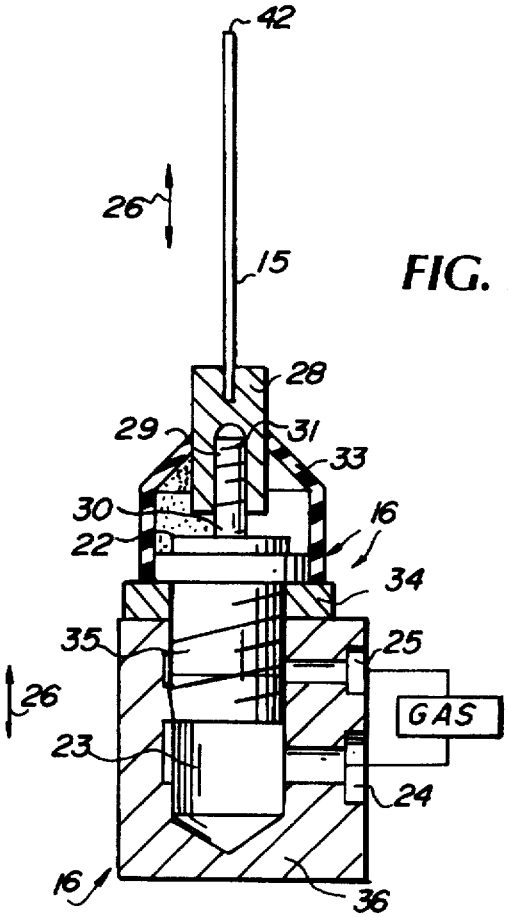
FIG. 2
FIG. 3
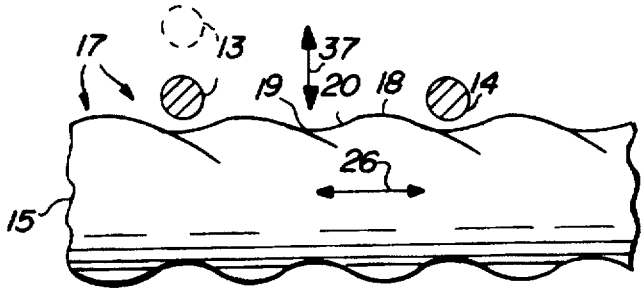
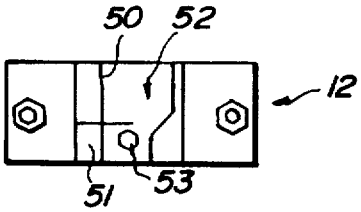
FIG. 5

CORONA WIRE CLEANING BY MECHANICAL VIBRATION OF THE WIRE

BACKGROUND AND SUMMARY OF THE INVENTION

Many commercial electrostatic imaging technologies, such as ion deposition printing technology (such as sold by Moore Business Forms of Lake Forest, Ill. under the trademark MIDAX™) utilize non-magnetic and non-conductive toner. Typically the toner is maintained in a fluidized bed, such as shown in European published application 494 454 (and in co-pending U.S. application Ser. No. 07/639,360 filed Jan. 8, 1991, now U.S. Pat. No. 5,532,100—the disclosure of which is hereby incorporated by reference herein), and the toner is ultimately applied to a member containing an electrostatic pattern such as an image cylinder. One way of charging the polymer based toner in a fluidized bed is to apply a strong electric field. This may be done by utilizing one or more corona wires which extend in the bed of toner. A large number of the toner particles are bombarded with positive ions which result from a strong electric field, changing the neutral charge of the particles to positive. The positive particles follow the electric field and eventually coat a transfer roller for application to a rotating image cylinder (for imaging a substrate). Particles which may remain neutral in charge, but are polarized, are attracted to the corona wire(s) and eventually lead to a build up of toner on the wire(s). This build up of insulating particles leads to a change in the electrical field gradient of the charging mechanism (wires), and eventually adversely affects the imaging uniformity.

The problem of particle build up on corona discharge elements is not unique to ion deposition, or imaging in general, technology. However, in other industries where corona charging methods are utilized the typical solution comprises using large spools of constantly moving corona wires so as to continuously introduce clean wires to the charging areas. However, this solution is impractical considering the small confines of the hoppers and beds utilized in imaging technology.

According to the present invention it has been found that it is possible to effectively keep the corona wires in a fluidized bed of toner clean enough so that the adverse consequences discussed above do not occur. That is, according to the present invention the wires are acted upon to substantially preclude build up of toner particles on the corona wire(s) which would substantially adversely affect imaging uniformity. A preferred method of accomplishing this build up is to vibrate the wire. For example, the wire may be vibrated at spaced points in time, and by causing it to go through a wide series of frequencies when vibrating, to literally shake the toner particles off. While vibration of the wire can be accomplished utilizing a wide variety of techniques, one particularly effective way is by utilizing a rod having an irregular surface, and reciprocating the rod to cause the irregular surface thereof to engage the corona wire to cause a quick rise and release thereof. For example, the rod may have a substantially sinusoidal shaped, surface which engages the corona wire and effects vibration thereof. A plurality of corona wires may be provided in which case the vibrating step is practiced to cause the rod sinusoidal surface to engage more than one wire at a time. For example, the rod may be reciprocated by effecting short, quick, bursts of movement of the rod.

According to one aspect of the present invention a method of charging non-magnetic toner in a fluidized bed of toner utilizing at least one corona wire, to image a substrate with the toner, is provided. The method comprises the steps of: (a) supplying electrical current to the at least one corona wire so that the wire charges non-magnetic toner surrounding the wire in the fluidized bed of toner; and (b) vibrating the wire to shake toner particles off of the wire to substantially preclude buildup of toner particles on the corona wire which would significantly adversely affect imaging uniformity. As indicated above, step (b) is typically practiced at spaced points in time, such as by reciprocating a rod having an irregular (e.g. substantially sinusoidal shaped) surface, step (b) being practiced to reciprocate the rod to cause the surface to engage the at least one wire and cause a quick rise and release thereof. Step (b) may be practiced by effecting short, quick, bursts of movement of the rod, and by causing the at least one wire to go through a wide series of frequencies when vibrating.

According to another aspect of the present invention a corona wire assembly in general is provided. The assembly comprises the following components: First and second corona wire support structures. At least one corona wire connectable to a source of electric current and extending between and supported by the support structures. And means for cleaning the at least one corona wire by effecting vibration thereof.

The cleaning means may comprise means for effecting vibration of at least one corona wire at spaced points in time. For example, the cleaning means may comprise structures at one or both ends of the corona wire for causing the wire to alternately become taut and flexed, or to cause one end to move with respect to the other; or by utilizing a device that impacts (e.g. resiliently) a wire at a central portion thereof, or by directing a fluid stream against the wire to effect vibration thereof, the stream either being pulsating or substantially continuous depending upon its direction, strength, and orientation with respect to the wire. However, in the preferred embodiment the cleaning means comprises a rod (of any cross section) having an irregular surface positioned to engage the at least one wire, and means for reciprocating the rod.

The irregular surface of the rod may comprise a substantially sinusoidal surface. The rod may comprise a stainless steel rod having a substantially circular cross section with a diameter thereof between about 0.02–0.04 inches (e.g. about 0.028 inches) etched with a smooth sinusoidal pattern along its length.

The means for reciprocating the rod may comprise any suitable conventional reciprocating structure, such as a pneumatic or hydraulic cylinder, a solenoid, a rack driven by a powered pinion, a cam follower engaging a rotating cam, or the like.

Guide means may be provided for precisely guiding the rod during reciprocation thereof. For example, low friction elements may be provided adjacent opposite ends of the rod to engage the rod on opposite surfaces thereof to guide it. The low friction elements may comprise blocks of low friction material such as a polytetrafluoroethylene, roller or ball bearings, sleeves of low friction material, or the like.

The supporting structures may include a spring for engaging and mounting the wire at or adjacent one end thereof. For example, the corona wire could comprise two corona wires which are integral at one end thereof, a length of wire being connected to a spring at one thereof to a first support structure, passing around a re-directing element on the opposite (second) support structure, and then being clamped to the opposite end thereof to the first support structure, the integral piece of wire thus forming two corona wires in the fluidized bed. Also, a plurality of high strength fiberglass rods may extend between the support structures to mount corona shields.

According to another aspect of the present invention a toner charging assembly is provided. The toner charging assembly comprises the following components: A fluidized bed of non-magnetic toner. First and second corona wire support structures. At least one corona wire connectable to a source of electric current and extending between and supported by the support structures, at least the majority of the corona wire in the fluidized bed and substantially surrounded by non-magnetic toner. And means for cleaning the at least one corona wire by effecting vibration thereof to shake toner particles off the wire.

The details of the cleaning means, corona wires, wire support structures, and the like are preferably as described above with respect to the corona wire assembly in general. The fluidized bed of non-magnetic toner may be formed in any suitable manner, such as shown in European patent application 494 454.

It is a primary object of the present invention to effectively keep corona wires clean, e.g. by vibrating the wire such as to shake toner particles off the wire to substantially preclude build up of toner particles which would significantly adversely affect imaging uniformity. This and other objects of the invention will become clear from an inspection of the detailed description of the invention, and from the appended claims.

BRIEF DESCRIPTION OF THE DRAWINGS

FIG. 2 is a side view, partly in cross section and partly in elevation, of the cleaning means of FIG. 1;

FIG. 3 is an enlarged schematic view of a portion of a reciprocating rod of the cleaning means of FIGS. 1 and 2, shown in cooperation with a pair of corona wires, the cleaning rod shown in elevation and the corona wires in cross section;

FIG. 5 is a schematic bottom view of the gear side top corona block of the assembly of FIG. 4.

DETAILED DESCRIPTION OF THE DRAWINGS

Figure 1:
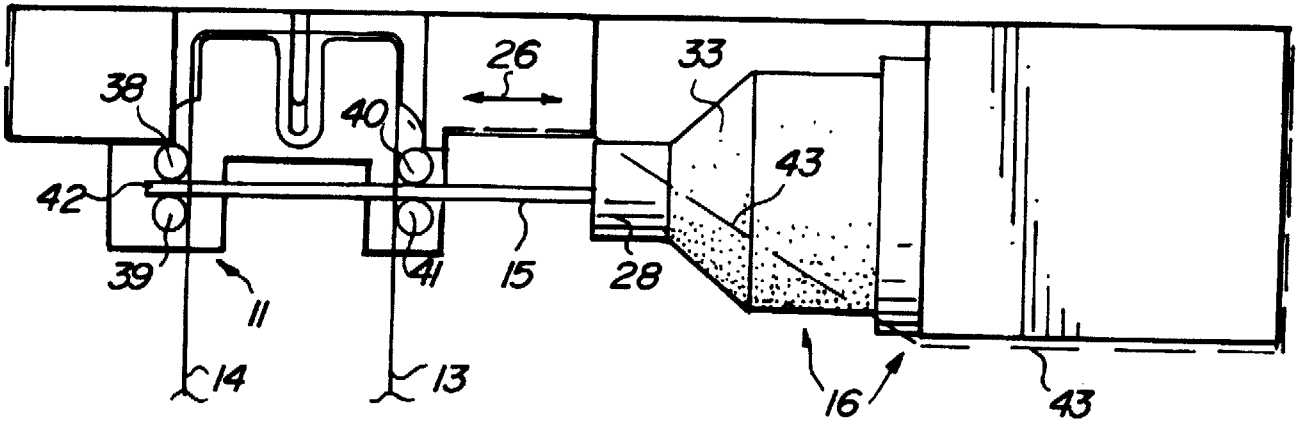
FIG. 1 is a schematic view looking in on one corona wire support structure in the middle of a fluidized toner bed with the supporting structure and a cleaning means according to the invention shown in elevation.

The invention relates, in the broadest concept thereof, to a corona wire assembly, particularly one in which corona wires are kept relatively clean. The assembly is shown generally by reference numeral 10 in FIG. 4 and various components thereof are shown at different orientation and in more detail in FIGS. 1 through 3 and 5.

Figure 4:
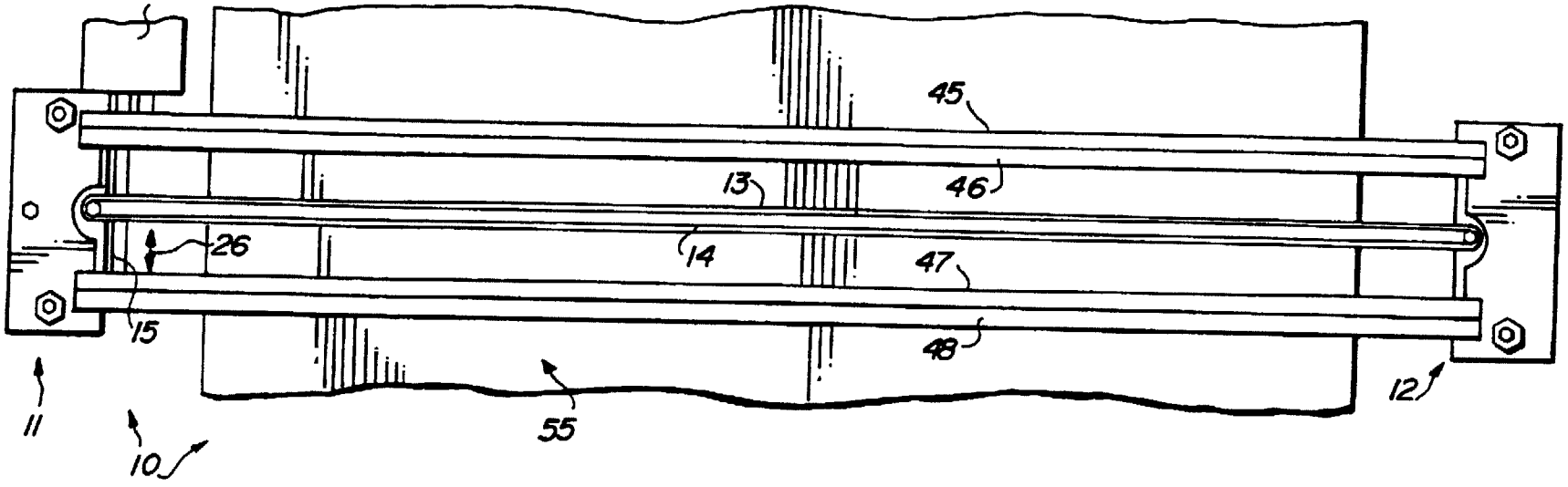
FIG. 4 is a bottom plan view of the support structures and interconnecting fiberglass rods utilized with the corona wires and cleaning means according to the invention.

The assembly 10 includes first and second corona support structures shown generally by reference numerals 11 and 12 in FIG. 4. A top view, looking from the fluidized bed of toner with which the assembly 10 is preferably employed, of the first supporting structure 11 is seen in more detail in FIG. 1, while the second support structure 12 is shown in bottom view (looking from the toner bed with which the assembly is preferably utilized) in FIG. 5. The supporting structure 11 is typically referred to as the operator side bottom corona block, while the support structure 12 is typically referred to as the gear side top corona block.

The assembly 10 further comprises at least one corona wire 13 (see FIGS. 1, 3, and 4) connectable to a conventional source of electric current (not shown in the drawings because it is entirely conventional) and extending between and supported by the support structures 11, 12. In the preferred embodiment illustrated in the drawings a second corona 14 is provided. Preferably the corona wires 13, 14 in the preferred embodiment of FIGS. 1, 3 and 4 comprises a single wire length which is bare along at least the vast majority of (e.g. more than 90%) the length thereof and which is redirected at a middle portion thereof so as to extend opposite the other end, thereby forming the two spaced wires 13, 14. For example, the free ends of a common wire length are connected to the supporting structure 12, with the center portion thereof looped around a portion of the structure 11, to define the individual spaced corona wires 13, 14. The wires 13, 14 are typically about 0.0025 inches in diameter.

The assembly 10 further comprises means for cleaning the wire 13 (and the wire 14 where provided, or any other number of wires provided) by effecting vibration thereof. While vibration may be effected in a wide variety of manners such as described above, in the preferred embodiment illustrated in the drawings the cleaning means comprises means for effecting vibration of the wires 13, 14 at spaced points in time utilizing a rod 15 (see FIGS. 1 through 3) and means for reciprocating the rod 15, such means shown schematically at 16 in FIGS. 1 and 2. The rod 15 may have any cross section (e.g. substantially circular, square, rectangular, or other polygon) and has an irregular surface, as seen generally by reference numeral 17 in FIG. 3. The irregular surface may be provided on all exterior portions of the rod 15 or, depending upon its shape, may be provided on only one exterior portion thereof. In the preferred embodiment the irregular surface 17 is substantially sinusoidal, as illustrated schematically in FIG. 3, having a uniform configuration of peaks 18 and valleys 19, with a smooth transition 20 therebetween. While the rod 15 may be constructed of a wide variety of materials in a number of different manners, one particular configuration that is desirable is a substantially circular cross section metal (e.g. stainless steel) rod, e.g. having a diameter between about 0.02–0.04 inches (e.g. about 0.028 inches), and etched with a smooth sinusoidal pattern along its length, as illustrated schematically in FIG. 3. Even a wider range of diameters (e.g. 0.0002–0.25 inches) is possible, normally the rod 15 having a diameter about ten times that of the wire 13.

The reciprocating means 18 may comprise any suitable reciprocating structure, such as described above (e.g. the hydraulic cylinder, solenoid, a rack and rotating pinion, etc.), but in the preferred embodiment illustrated in the drawing comprises a pneumatic cylinder. For example, the piston 22 (see FIG. 2) is disposed within a cylinder 23 supplied with compressed gas (and vented) by a port 24, 25, the piston 22 moving up and down in the direction of the arrows 26 in FIG. 2, causing reciprocation of the rod 15 also in the same direction. In the embodiment illustrated in FIG. 2 the rod 15 is connected to the piston 22 of the pneumatic cylinder 16 by a connector 28 which may be, for example, a 0.5 inch long by 0.25 inch diameter cylindrical Delrin™ connector. The connection between the connector 28 and the piston 22 may be effected by the exterior threads 29 on the extension portion 30 of the piston 22, and interior threads 31 in the connector 28.

A rubber, or other flexible material, shaft seal (boot, sleeve) 33 preferably is provided that slips over and tightly resiliently engages the connector 28, and is attached to the piston 22 via an aluminum washer 34 or the like. The entire piston 22, cylinder 23 assembly may be screwed (see screw threads 35 in FIG. 2) into a main air cylinder block 36 which contains the ports 24, 25.

The ports 24, 25 may have gas supplied thereto, and/or they may be vented by any suitable automatic structure, such as a periodically, intermittently, or randomly operated valving mechanism. The gas causes the piston 22 (and thus the rod 15) to move in short, quick, bursts, which effects a high, ever changing, vibrational frequency. As the rod 15 is reciprocated in direction 26 as seen in FIG. 3, the irregular surface 17 thereof, with the peaks 18 and valleys 19, results in a quick rise and release of the corona wires 13, 14, causing vibration as indicated schematically by the dotted line position of wire 13 in FIG. 3, and the arrows 37 in FIG. 3.

Typically a short, quick burst is effected by reciprocating the rod 15 for about one second (e.g. between about 0.25–4 seconds) and then resting for about one second (e.g. between about 0.25–4 seconds). The force necessary to effect vibration is about ten pounds.

It is preferable to positively guide the rod 15 during its movement in direction 26. This is accomplished by utilizing positive guiding means, which may take a wide variety of forms such as described above. In the preferred embodiment of the invention the guiding means comprises stainless steel ball bearings (e.g. 3/32 inch in diameter) 38 through 41 as illustrated in FIG. 1. The ball bearings 38 through 41 are pressed in the block/supporting structure 11 and they are either a spaced distance from each other effective to positively guide the rod 15, or spring pressed or otherwise biased toward engagement with each other. With the air piston 22 in its fully retracted position (that is no pressure being supplied) the tip 42 of the rod 15 extends just to the end of the ball bearings 38, 39, as illustrated in FIG. 1.

It is desirable in utilizing the cleaning means, as illustrated in FIG. 1, that kapton tape be placed under the entire assembly, as indicated in dotted line at 43 in FIG. 1.

It is also desirable to provide a structure for supporting corona shields, which are desirable when full operative length of the corona wires 13, 14 is not necessary (such as when printing on narrow webs/substrates). This is preferably accomplished according to the invention by providing a plurality of high strength fiberglass rods extending between support structures as illustrated in FIG. 4, the individual rods being shown by reference numerals 45 through 48. The rods 45 through 48 may also facilitate precisely positioning the supporting structures 11, 12 with respect to each other.

The corona wires 13, 14 may be mounted to the support structures 11, 12 in any suitable manner. One particular way that this can be accomplished is by utilizing—as seen with respect to FIG. 5—a corona wire tensioning spring (e.g. a coil spring) 50 mounted on a small post 51, a corona clamp 52, and a threaded nylon pan head screw 53 for holding the clamp 52 in place. In one preferred manner for mounting the wires 13, 14, a single length of preferably bare corona wire length (e.g. about 20 inches long) is connected at one end thereof to the spring 50 and at the other end thereof to the clamp 52. For example, a small length (e.g. about a quarter of an inch) of the wire at one end thereof is passed through a loop of the spring 50, then the spring 50 is twisted. Care must be taken to insure that too much wire is not twisted beyond the spring loop since that may cause an irregularity in the toning process and therefore the print, assuming that the assembly 10 is used for imaging a substrate (web). Then the spring 50 is placed on the post 51.

Then the corona wire is extended and looped around a groove on the operator side corona block 11 and the wire is pulled back to the gear side block 12 and placed under the clamping mechanism 52. Then the nylon screw 53 is tightened while applying tension to the wire. Enough tension should be applied for the coils of the spring 50 to begin to separate. Thus, a single wire length is used to form the two spaced corona wires 13, 14 which extend between the supporting structures 11, 12, and have appropriate tension thereon.

The preferred use of the assembly 10 according to the invention is in a toner charging assembly, that is in which the structures described above are utilized with a fluidized bed of non-magnetic toner. The fluidized bed may be maintained as generally provided in European patent application 494 454. In use, preferably the reciprocating means 16 is periodically, intermittently, randomly, or at other spaced points in time, activated to cause the rod 15 to be reciprocated, moving in the direction 26 positively guided by the ball bearings 38 through 41. A quick short burst of movement of the rod 15 is provided, causing the corona wires 13, 14 to be engaged by the peaks and valleys 18, 19 of the surface 17 of the rod 15, and causing the wires 13, 14 to vibrate. This vibration shakes substantially all of the toner particles which may have built up on the wires 13, 14, the quick rise and release of the wire 13, 14 causing them to go through a wide series of frequencies and dislodging the particles. The reciprocating means 16 is actuated with sufficient frequency so as to insure that build up of toner particles on the wires 13, 14 which would significantly adversely affect imaging uniformity is substantially precluded.

The toner in the non-magnetic toner bed 55 is charged by the corona wires 13, 14, and the positively charged particles follow the electric field established by the corona wires and eventually coat a transfer roller, which ultimately (such as utilizing the system illustrated in European patent application 494 454) causes the toner to be transferred to a member (such as an image cylinder) containing an electrostatic pattern, and ultimately transferred by that member to a moving web, or other substrate, to image the substrate.

While use in the printing industry is one very desirable use of the invention, it is useful in many other industries as well as (e.g. the fluid spraying (plasma coating) industry).

It will thus be seen that according to the present invention an advantageous method and assembly have been provided for charging of non-magnetic toner over long periods of time, and for preventing the build up of toner particles on corona wires. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent methods and assemblies.

What is claimed is:

1. A toner charging assembly comprising:

a fluidized bed of non-magnetic toner;

first and second corona wire support structures;

at least one corona wire connectable to a source of electric current and extending between and supported by said support structures, at least the majority of said corona wire in said fluidized bed and substantially surrounded by non-magnetic toner; and means for cleaning said at least one corona wire by effecting vibration thereof including a vibratory inducing mechanical actuator connected to said one corona wire to shake toner particles off said wire.

2. A method of charging non-magnetic toner in a fluidized bed of toner using at least one corona wire, to image a substrate with the toner, comprising the steps of:

(a) supplying electrical current to the at least one corona wire so that the wire charges non-magnetic toner surrounding the wire in the fluidized bed of toner;

(b) vibrating the wire to shake toner particles off of the wire to substantially preclude buildup of toner particles on the corona wire which would significantly adversely affect imaging uniformity; and utilizing a rod having an irregular surface; and wherein step (b) is practiced by reciprocating the rod to cause the irregular surface thereof to engage the at least one wire and cause a quick rise and release thereof.

3. A method as recited in claim 2 wherein step (b) is practiced by effecting short, quick, bursts of movement of the rod.

4. A method of charging non-magnetic toner in a fluidized bed of toner using at least one corona wire, to image a substrate with the toner, comprising the steps of:

(a) supplying electrical current to the at least one corona wire so that the wire charges non-magnetic toner surrounding the wire in the fluidized bed of toner;

(b) vibrating the wire to shake toner particles off of the wire to substantially preclude buildup of toner particles on the corona wire which would significantly adversely affect imaging uniformity; and utilizing a rod having a substantially sinusoidal shaped surface; and wherein step (b) is practiced by reciprocating the rod to cause the substantially sinusoidal surface thereof to engage the at least one wire and cause a quick rise and release thereof.

5. A method as recited in claim 4 wherein the at least one corona wire comprises a plurality of corona wires; and wherein step (b) is practiced by causing the rod sinusoidal surface to engage more than one wire at a time.

6. A corona wire assembly, comprising:

first and second corona wire support structures;

at least one corona wire connectable to a source of electric current and extending between and supported by said support structures; and means for cleaning said at least one corona wire by effecting vibration thereof including means for effecting vibration of said at least one corona wire at spaced points in time and a rod having an irregular surface positioned to engage said at least one wire, said irregular surface comprising a substantially sinusoidal surface.

7. A corona wire assembly as recited in claim 6 wherein said irregular surface comprises a substantially sinusoidal surface.

8. A corona wire assembly as recited in claim 6 wherein said reciprocating means comprises a pneumatic cylinder.

9. A corona wire assembly as recited in claim 6 wherein said rod comprises a stainless steel rod having a substantially circular cross section with a diameter of between about 0.02–0.04 inches.

10. A toner charging assembly comprising:

a fluidized bed of non-magnetic toner;

first and second corona wire support structures;

at least one corona wire connectable to a source of electric current and extending between and supported by said support structures, at least the majority of said corona wire in said fluidized bed and substantially surrounded by non-magnetic toner;

means for cleaning said at least one corona wire by effecting vibration thereof and including a rod having an irregular surface positioned to engage said at least one wire, and means for reciprocating said rod.

11. A toner charging assembly as recited in claim 10 wherein said irregular surface comprises a substantially sinusoidal surface; and further comprising guide means for precisely guiding said rod during reciprocation thereof; and wherein said reciprocating means comprises a pneumatic cylinder.

12. A toner charging assembly comprising:

a fluidized bed of non-magnetic toner;

first and second corona wire support structures;

at least one corona wire connectable to a source of electric current and extending between and supported by said support structures, at least the majority of said corona wire in said fluidized bed and substantially surrounded by non-magnetic toner; and means for cleaning said at least one corona wire by effecting vibration thereof;

said supporting structures including a spring for engaging and mounting said wire at or adjacent one end thereof; and further comprising a plurality of high strength fiberglass rods extending between said support structures for supporting corona shields.

13. A corona wire assembly, comprising:

first and second corona wire support structures;

at least one corona wire connectable to a source of electric current and extending between and supported by said support structures; and means for cleaning said at least one corona wire by effecting vibration thereof including means for effecting vibration of said at least one corona wire at spaced points in time, a rod having an irregular surface positioned to engage said at least one wire, and a pneumatic cylinder for reciprocating said rod.

14. A corona wire assembly as recited in claim 13 wherein said rod comprises a stainless steel rod having a substantially circular cross section with a diameter of between about 0.02–0.04 inches.

* * * * *